United States Patent [19]

Thomas

[11] Patent Number: 4,732,170

[45] Date of Patent: Mar. 22, 1988

[54] COMBINATION HAIR STRAND SEPARATING IMPLEMENT AND COMB

[76] Inventor: Louis N. Thomas, 990 NE. 156 Ter., North Miami Beach, Fla. 33162

[21] Appl. No.: 916,804

[22] Filed: Oct. 8, 1986

[51] Int. Cl.[4] ..... A45D 24/00

[52] U.S. Cl. ..... 132/151; 132/160

[58] Field of Search ..... 132/151, 148, 160, 156, 132/123, 147, 145

[56] References Cited

U.S. PATENT DOCUMENTS 2,137,828 11/1938 Arpin et al. ..... 132/123

4,325,393 4/1982 Thomas ..... 132/151

FOREIGN PATENT DOCUMENTS 818549 10/1951 Fed. Rep. of Germany ..... 132/160

*Primary Examiner*—Robert Peshock

*Assistant Examiner*—Cary E. Stone

*Attorney, Agent, or Firm*—Ernest H. Schmidt

[57] ABSTRACT

A hair styling implement for facilitating the withdrawal of spaced groups of hair strands from the scalp for separate treatment with bleach or the like for "frosting" or "streaking" combines a comb having a comb back portion which extends into a pick-type handle at one end with a plurality of equi-distantly spaced, arcuate hook members moveable between open and closed positions with respect to the outer edge of the comb back portion by operation of a slide member with the use of the thumb while holding the handle. After combing the hair the implement will be manipulated in the hand to grip the comb back instead of the handle, enabling use of the pick-like handle for slightly lifting certain hair lock portions at which strand separation is to take place, after which the handle will be held such that the open hook members are placed close to the scalp near the roots of the prepared hair strands to be separated from the rest of the hair, whereafter, upon closing the hook members, the implement can be lifted from the scalp to isolate the strand groups thus selected for treatment.

6 Claims, 9 Drawing Figures

12
32
15
10
41
17
14
14
13
18
11

12
10
37
11

12
10
15
16
37
14a
14
13
11
14
14

COMBINATION HAIR STRAND SEPARATING IMPLEMENT AND COMB

BACKGROUND OF THE INVENTION

In the hair styling procedure commonly referred to as "frosting" or "streaking", spaced groups of hair strands are separated from the scalp hair and treated with bleach or dye solutions, or pastes, to present the desired color streaked or "frosted" effect. Various procedures have been devised for such hair treatment, all of which are tedious to perform and require substantial skill on the part of the operator, if satisfactory results are to be achieved. In the procedure usually used if substantial portions or the entire head of hair is to be streaked or frosted, an impervious cap is placed over the scalp and selected strand groups are pulled through openings in the cap with a hook-like implement inserted through small openings in the cap at the desired locations, after which they are separately treated with bleaching paste or the like at the outside of the cap.

In another procedure, the operator selects locks of hair from the scalp with the use of a comb, holds the hair thus lifted between the third and fourth finger of the opposite hand, and then weaves a "rats-tail", usually a projection at one end of the comb, in and out along the lock of hair so held to separate spaced strand portions to one side for treatment. This procedure is repeated successively at various locations on the scalp to achieve a desired overall effect in the finished coiffure. It will be readily apparent that this method of weaving a rat-tail or elongated pick at the end of the comb in and out of locks of hair to effect separation of hair strand groups for color treatment requires great dexterity on the part of the operator, and is particularly time consuming if substantial portions of the hair are to be treated.

In my U.S. Pat. No. 4,325,393, issued Apr. 20, 1982, I describe a hair strand separating implement with spaced hook members moveable between open and closed positions to facilitate the withdrawal, simultaneously, of spaced groups of hair strands from the scalp for separate "frosting" or "streaking" treatment, thereby obviating the deficiency of previous procedures for this purpose. It is the principal object of the present invention to provide a novel and improved combination hair strand separating implement and comb which is even more time saving and efficient in that it eliminates the need for the operator to switch between use of a comb or brush and a multiple strand lifting implement during a "frosting" or "streaking" procedure.

A more particular object is to provide a combination hair strand separating implement and comb wherein the hair strand hooking mechanism is actuated and released with use of the thumb while holding the device for use as a comb, whereby the device can be quickly manipulated in the hand for use either as a comb or for interhooking combed hair strands to be selected for treatment.

Another object of the invention is to provide a novel and improved combination hair strand separating implement and comb of the character described that is so simple and effective in operation as to be well suited to self use by individuals in hair "streaking" or "frosting".

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figures 1, 2, 3:
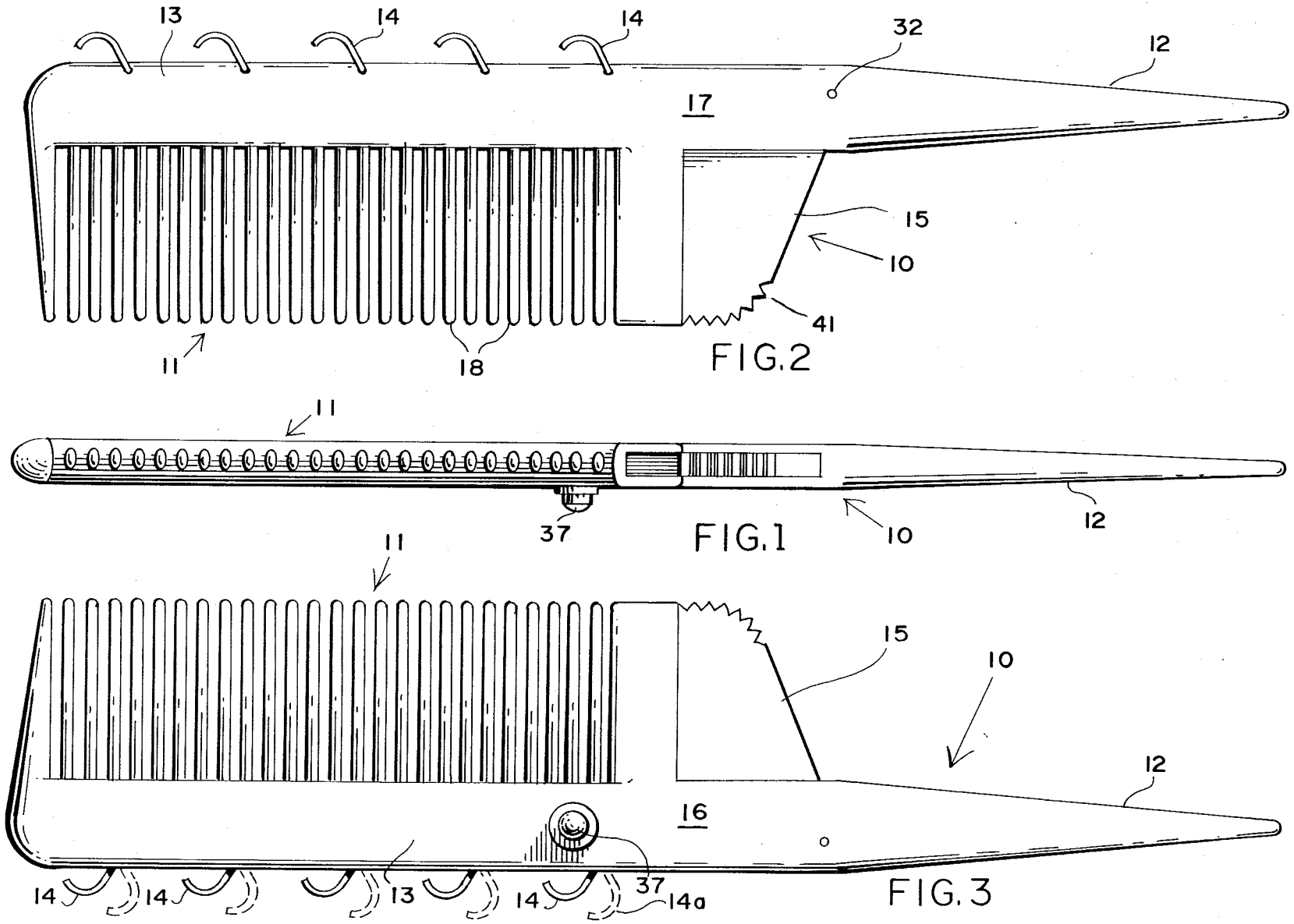
FIG. 1 is a front elevational view of a combination hair strand separating implement and comb embodying the invention.
FIG. 2 is a left side elevational view thereof.
FIG. 3 is an upside-down right side elevational view thereof.

Referring first to FIGS. 1, 2 and 3 of the drawings, it will be seen that the combination hair strand separating implement and comb, 10, hereinafter also referred to as a hair styling device, comprises a comb portion 11, having a short picktype handle 12 at one end. The back 13 of the comb portion has a plurality of hook members 14, equi-distantly spaced along the back edge and projecting outwardly therefrom;

As is hereinafter more particularly described, the comb back 13 contains, for the most part, an actuating slide member 15 which, when pushed forwardly by the thumb with respect to the upright, or gripping handle 12 serves, through internal mechanism hereinafter described, to move the hook members 14 between their closed positions as illustrated in full lines and their open positions, as illustrated by the broken-line representations thereof in FIG. 3.

Figure 8:
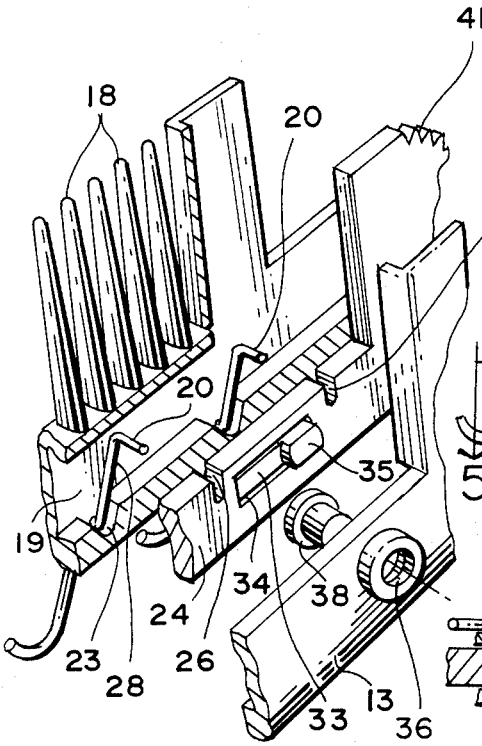
FIG. 8 is a partial oblique "exploded view" of the device as seen from the right side and illustrating mechanical details of the slide mechanism.
Figure 4:
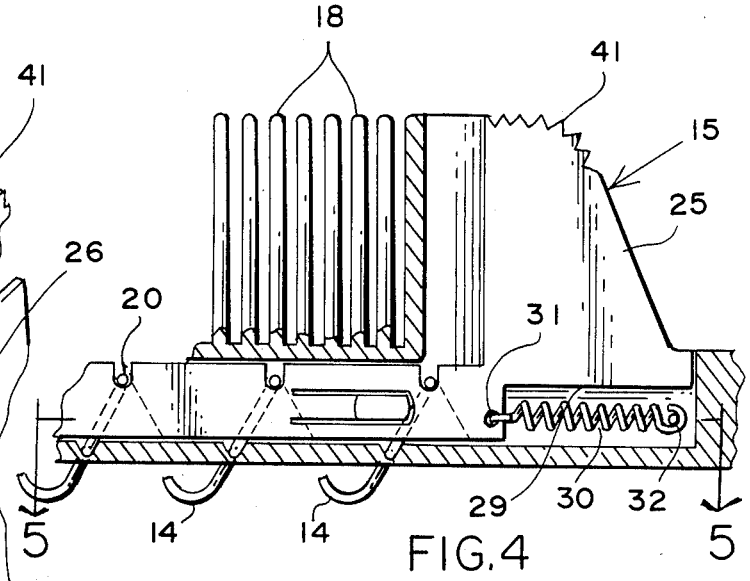
FIG. 4 is a partial, longitudinal cross-sectional view.
Figure 5:
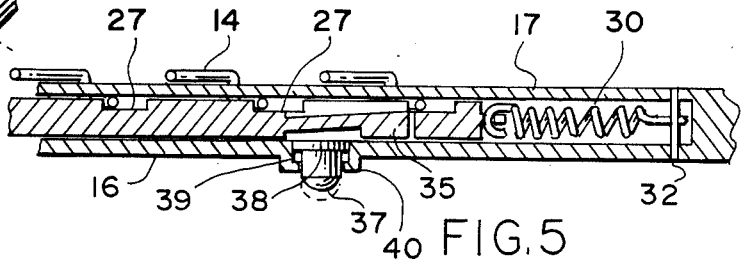
FIG. 5 is a transverse, cross-sectional view, taken along the line 5—5 of FIG. 4 in the direction of the arrows.
Figure 6:
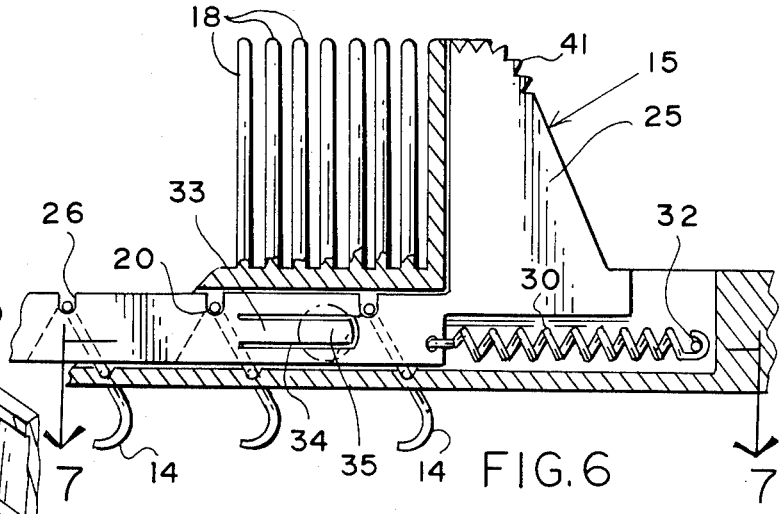
FIG. 6 is a cross-sectional view, similar to that of FIG. 4, but showing the actuating slide member in a forward position, for moving the associated hook members to open position.

The body of the hair styling device 10 comprises integrally molded left and right side shell portions 16, 17, respectively, which, upon assembly of the device, are secured together by a suitable cement. The right shell portion 17, as best illustrated in FIGS. 4, 6, and 8, is formed along the comb back portion with the usual outwardly extending comb teeth, 18. The comb back portion of the right shell portion 17 is also formed along its length with a longitudinally-extending rectangular recess 19, within which the slide member 15 is slidingly disposed in the manner and for the purpose hereinafter more particularly described. As best illustrated in FIGS. 4, 5, and 8, the hook members 14 are preferably formed by bending of stiff wire, and are provided, centrally along their lengths, with short, laterally-offset pivot portions and inner end hook portions 20 extending sidewardly at right angles to the common plane of the hooks. The hook members 14 extend through openings 22 in the comb back 13 (see FIG. 9), which communicate with the rectangular recesses 19 of right shell portion 17 through V-shaped recesses 23 formed in the bottom wall of the rectangular recess 19.

Figure 9:
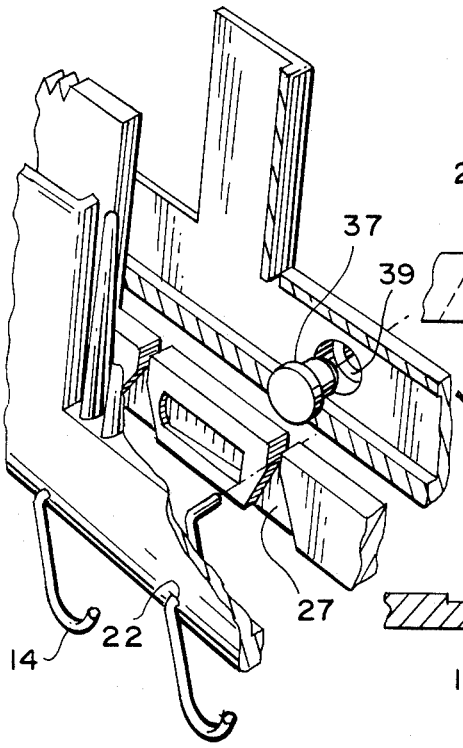
FIG. 9 is a partial, oblique "exploded view" of the device as seen from the left side and further illustrating mechanical details of the slide mechanism.

As illustrated in FIGS. 4 through 9, the actuating slide member 15 is flat and integrally formed with a slide bar portion 24 from the rear end of which a thumb-actuating portion 25 projects. The slide bar portion 24 is slidingly received within the rectangular recess 19, and has a plurality of equi-distantly spaced slots 26 along its upright edge for the reception, one each, of the sidewardly extending portions 20 of the hook members 14. As best illustrated in FIG. 9, the seated side of the slide bar portion 24 is formed with triangular recesses 27, communicating at the apices thereof with the slots 26. The triangular recesses 27 serve as relief openings for the upper arm portion 28 of hook members 14.

As best illustrated in FIGS. 4 and 5, the thumb actuating portion 25 of the actuating slide member 15 is provided with an elongated rectangular recess 29 for the reception therein of a helical tension spring 30. One end of the tension spring 30 hooks through an opening 31 at the rear end portion of the slide bar portion 24, and the other end thereof is hooked around a transverse retaining pin 32 which extends through back portion openings of the left and right shell portions 16 and 17 of the body of the device upon assembly. The tension spring 30 thus yieldingly constrains the actuating slide member 15 in its rearward-most position whereat, as illustrated in FIG. 4, the thumb actuating portion 25, at its lower end, abuts against the back wall of the rectangular recess 19 within which the actuating slide member 15 slides.

Figure 7:
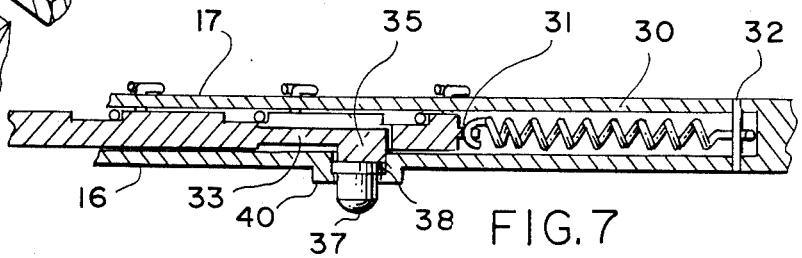
FIG. 7 is a transverse cross-sectional view taken along the line of 7—7 of FIG. 6.

Means is provided for automatically locking the actuating slide member 15 with the hook members in open position, as illustrated in FIGS. 6 and 7. To this end, the slide bar portion 24 is provided along its length with a locking tongue member 33 moveable sideways within a longitudinally-extending, elongated rectangular recess 34 provided therein. The forward end of the locking tongue member 33 extends integrally from the forward wall of the recess 34 and terminates in a sidewardly outwardly-extending latch portion 35, having arcuate front and rear portions defining a cylinder. As best illustrated in FIG. 5, the shank of the locking tongue member 33 is of reduced thickness and is formed of a resilient material, bent outwardly in the direction of the latch portion 35 so that said latch portion normally projects beyond the pertaining sidewall of the remainder of the slide bar portion 24.

There is slidingly received within a circular opening 36, formed within the left shell portion 16 of the body of the device, a cylindrical lock release button 37. As best illustrated in FIG. 5, the button 37 is formed at its inner end with a circular flange portion 38 which, when said button in its outermost position, as illustrated by the broken line representation thereof in FIG. 5, seats against an annular seat 39 provided within an outwardly-projecting boss portion 40, integrally formed in surrounding relation with respect to circular button opening 36.

In operation, when the actuating slide member 15 is pushed by the thumb against the serrated upper portion 41 in a forward direction against the yielding force of the tension spring 30, the slide bar latch portion 35, upon reaching the circular opening 36, which is of slightly greater diameter, will move, under the leaf spring action of the locking tongue member, into said opening, thereby latching against automatic withdrawal upon removal of the thumb. The hook members 14 will thus be automatically retained in their open positions, as illustrated in FIG. 7.

Release for automatic withdrawal of the actuating slide member 15 under the tensional forces of helical tension spring 30 can thereafter be effected by pressing the release button 37, which serves to push the latch portion 35 out of latching position within the opening 36. The actuating slide member 15 will thereupon spring backwardly to its rest position as illustrated in FIG. 4, whereat the hook members 14 are in closed position. It will be understood that the hook members 14, pivotally supported along their lengths in the comb back openings 22, are swung back and forth between open and closed positions by virtue of their sidewardly-extending portions 20 being correspondingly moved by their being captured within the slide bar openings 26.

In use, the combination hair styling device will first be employed in ordinary fashion as a comb to arrange the hair at the scalp for separation into groups of hair strands to be treated. At this time the device can readily be manipulated in the hand to grip the comb back instead of the handle, enabling use of the pick-like handle in slightly lifting selected hair lock portions at which the strand separation is to take place. Thereafter, the handle will be held in such a way that the hook members 14 will be placed close to the scalp near the roots of the prepared hair strands to be separated from the rest of the hair, with the hook members 14 in open position as illustrated by the broken-line representation in FIG. 3. As described above, this will have been accomplished by pushing forwardly with the thumb upon the actuating slide member 15. With the device thus positioned, the lock release button will next be depressed to move the hook members from the open position to the closed position as illustrated in FIG. 2 for example, so as to interhookingly grasp spaced groups of the hair strands for separate treatment. The device will then be moved away from the scalp to lift the groups of hair strands so selected, whereafter bleaching or other treatment will be accomplished in the usual fashion. After the spaced strand groups have been thus separated for treatment, the actuating slide member 15 will be pushed forwardly into open-lock position, as illustrated in FIG. 6, thereby unhooking from and releasing the selected hair strands, after whick the device will be ready for use again in separating and isolating other groups of hair strands for treatment at another position of the scalp.

The principal advantage of the invention resides in the simplicity and rapidity with which evenly spaced groups of hair strands may be both prepared for selection and selected for frosted treatment or the like from locks of hair at any portion of the scalp. A salient feature of the invention, moreover, resides in the time saving and uniformity of streaking achieved with use of the combination hair strand separating and implement and comb, which is particularly advantageous when substantial portions of a hair styling or coiffure are to be streak bleached or streak dyed.

While I have illustrated and described herein only one form in which my invention can be conveniently embodied in practice, it is to be understood that this embodiment is presented by way of example only and not in a limiting sense. The invention, in brief, comprises all the embodiments and modifications coming within the scope and spirit of the following claims.

What I claim as new and desire to secure by Letters Patent is:

1. A combination hair strand separating implement and comb for use in the withdrawal of spaced groups of hair strands from the scalp for separate treatment comprising, in combination, a hair comb, said hair comb having a back portion, said comb back portion extending into and joining a pick-type handle at one end, a plurality of hook members journalled in spaced relation along one side of said comb back portion, said hook members each being integrally formed with arcuate hook portions moveable between withdrawn and outwardly extended positions with respect to the outer edge of said comb back portion, said arcuate hook portions terminating in end portions which, when said hook portions are in withdrawn position are moved into closely spaced, opposed relation with respect to said outer edge of said comb back portion and means for simultaneously rotating said hook members for moving said arcuate hook portions between said withdrawn and outwardly extended positions, said hook members being integrally formed of bent wire and said hook member rotating means comprising an operating slide bar supported for longitudinally sliding movement within said comb back portion between forwardmost and rearwardmost positions with respect thereto, and crank means on said hook members extending through slots in said slide bar for cooperative movements therebetween.

2. A combination hair strand separating implement as defined in claim 1 wherein said operating slide member comprises a thumb actuating portion integrally formed with said slide bar and extending side wardly outwardly of the juncture of said comb back portion and said picktype handle.

3. A combination hair strand separating implement as defined in claim 2 including spring means normally constraining said operating slide bar in its rearwardmost position, whereat said arcuate portions will be in their withdrawn positions.

4. A combination hair strand separating implement as defined in claim 3 wherein said spring means comprises a helical compression spring constrained between the rearward end of said slide bar and an inner end portion of said picktype handle.

5. A combination hair strand separating implement as defined in claim 4 including means for releaseably locking said operating slide bar in its forwardmost position, whereat said arcuate hook portions will be in their outwardly-extended positions.

6. A combination hair strand separating implement as defined in claim 5 wherein the tips of said arcuate hook portions are tapered and are so located and disposed with respect to said outer edge of said comb back portion when in their outwardly-extended positions as to rest flat against the scalp upon the back portion of said comb being placed in closely spaced relation with respect to the scalp.

* * * * *